US009555317B1

(12) United States Patent
Tompkins

(10) Patent No.: US 9,555,317 B1
(45) Date of Patent: Jan. 31, 2017

(54) METHOD AND SYSTEM FOR PLAYING A CARD GAME THAT INCLUDES WAGERS FOR DEALT HAND POSITIONS

(71) Applicant: Charles G. Tompkins, Tulsa, OK (US)

(72) Inventor: Charles G. Tompkins, Tulsa, OK (US)

( * ) Notice: Subject to any disclaimer, the term of this patent is extended or adjusted under 35 U.S.C. 154(b) by 0 days.

(21) Appl. No.: 15/253,842

(22) Filed: Aug. 31, 2016

(51) Int. Cl.

| | |
|---|---|
| ***A63F 1/18*** | (2006.01) |
| ***A63F 1/00*** | (2006.01) |
| ***G07F 17/32*** | (2006.01) |
| *A63F 11/00* | (2006.01) |
| *A63F 3/00* | (2006.01) |
| *A63F 1/06* | (2006.01) |

(52) U.S. Cl.
CPC ..... *A63F 1/00* (2013.01); *G07F 17/3209* (2013.01); *G07F 17/3225* (2013.01); *G07F 17/3244* (2013.01); *G07F 17/3293* (2013.01); *A63F 1/067* (2013.01); *A63F 1/18* (2013.01); *A63F 3/00157* (2013.01); *A63F 11/00* (2013.01); *A63F 11/0002* (2013.01); *A63F 2003/00164* (2013.01)

(58) Field of Classification Search
CPC .. A63F 1/18; A63F 11/00; A63F 2003/00164; A63F 1/067; A63F 3/00157; A63F 11/0002
USPC ..... 273/309, 287, 292, 296, 274
See application file for complete search history.

(56) References Cited

U.S. PATENT DOCUMENTS

| | | | | |
|---|---|---|---|---|
| 5,669,817 | A * | 9/1997 | Tarantino | A63F 3/00157 273/309 |
| 5,788,574 | A * | 8/1998 | Ornstein | G07F 17/3244 273/309 |
| 5,823,875 | A * | 10/1998 | Tarantino | G07F 17/3244 273/274 |
| 6,264,200 | B1 * | 7/2001 | Smith | A63F 1/00 273/274 |
| 6,585,267 | B2 * | 7/2003 | Webb | A63F 3/00157 273/274 |

* cited by examiner

*Primary Examiner* — Benjamin Layno
(74) *Attorney, Agent, or Firm* — Mark Young, P.A.

(57) ABSTRACT

A card game entails betting on the rank, suit, rank and suit, color, odd/even value of a card dealt to one of two positions on a table. Using a two-sided selector (button), a player selects which of the two position will count. The selection is made prior to dealing or revealing the dealt cards. Players may also bet on whether the two cards are a pair. The selector is placed in a compartment of a selector rack during the round of play.

20 Claims, 7 Drawing Sheets

15 to 1

1 to 1

1 to 1

2 / WILD
JACKS

JOKERS
PLUS 12

SINGLE JOKER

DOUBLE JOKER

METHOD AND SYSTEM FOR PLAYING A CARD GAME THAT INCLUDES WAGERS FOR DEALT HAND POSITIONS

FIELD OF THE INVENTION

This invention relates generally to a card game, and, more particularly, a card game played at a table with a dealer, at least one deck of cards, chips or cheques, an indicator for player selection of one of two positions of two dealt cards, and a rack or tray with a compartment for receiving the indicator, displaying the selection and identifying the selecting player during the round of play.

BACKGROUND

Many card games are played at card tables with a dealer, using one or more decks of cards, indicia on the table to guide play and/or define spaces for card or chip placement. Rules of play, possible wagers and odds vary considerably from game to game. The number of cards dealt and method of dealing also vary considerably.

In many games, a player must specify a choice. Often the player verbally states his or her choice or makes a commonly recognized gesture (e.g., a wave of the hand or a slide of a card) to indicate a choice to other players and the dealer. Unfortunately, such communications are easily missed, susceptible to misunderstanding and vulnerable to abuse.

Cheating has always been a problem for card games. Sleight of hand and rigged games dishonestly part many players and houses from their hard earned money.

Steps that involve gestures or spoken words are particularly vulnerable to cheating. Casino cameras may not capture a player's instruction, whether verbal or gesture. Additionally, such instructions are transient and may be quickly withdrawn and replaced. The withdrawal and replacement instructions are equally difficult to track, particularly in a busy casino.

What is needed is a game that features new game with stationary visible indicators for player choices. Thus, each round of play can be thoroughly visualized to monitor integrity.

The invention is directed to overcoming one or more of the problems and solving one or more of the needs as set forth above.

SUMMARY OF THE INVENTION

To solve one or more of the problems set forth above, in an exemplary implementation of the invention, a game according to principles of the invention is played with a deck of cards, a unique indicator device, and a rack with player position compartments for containing the indicator during a round of play. A dealer will deal two cards to two positions (one card to each of two positions) on a game table. However, prior to the dealing, a player, using the indicator (referred to herein as a button) selects which of the two positions will be the selected card. The selection is made by the player by turning the button with a side facing up that corresponds to the selected position. The card in that position will be the primary card for the round of play.

Players take turns making a selection for each successive round of play. For example, a player in seat 1 may make the selection for the first round of play. A player in seat two may make the selection for the second round of play, and so on.

The button is placed in a compartment of a rack. The selected side of the button faces upward. The rack includes a separate compartment corresponding to each player. The button is placed in the compartment corresponding to the selecting player, with the selected side facing upwardly. A transparent lid or cover may be placed over the contained button during the round of play.

After the dealer deals the two cards, each to one of the two positions, the cards are turned over. Then the dealer determines if the cards are a pair (i.e., of the same rank). If they are not a pair, the card in the non-selected position may be discarded. If they are a pair, any wagers on the cards being a pair will win and receive a payout. Then the dealer determines if other wagers on the selected card win or lose. Such wagers may include wagers on the rank, suit, rank and suit, and color of the card, as well as whether the card is odd or even. Winning wagers receive a payout according to a determined payout schedule. During the next round of play the next player in turn determines the selected position using the button.

In this manner, all aspects of game play can be visually monitored by the dealer, players, onlookers and security. Even the player who made the selection can be determined for each round of play by viewing the compartment of the rack that contains the button.

BRIEF DESCRIPTION OF THE DRAWINGS

The foregoing and other aspects, objects, features and advantages of the invention will become better understood with reference to the following description, appended claims, and accompanying drawings, where:

Figure 1:
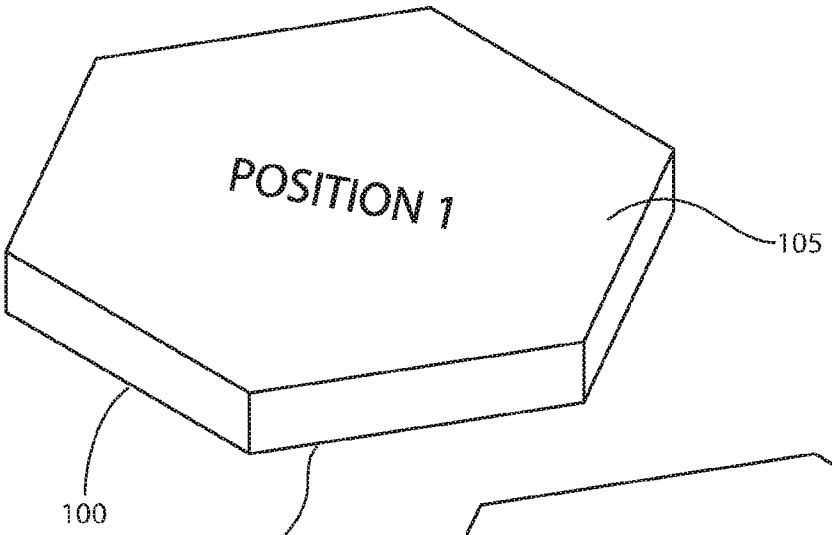
FIG. 1 is a top-side perspective view of an exemplary button for a game according to principles of the invention.

Those skilled in the art will appreciate that the figures are not intended to be drawn to any particular scale; nor are the figures intended to illustrate every embodiment of the invention. The invention is not limited to the exemplary embodiments depicted in the figures or the specific steps, components, configurations, shapes, relative sizes, ornamental aspects or proportions as shown in the figures.

DETAILED DESCRIPTION

A game according to principles of the invention is played with a deck of playing cards. A preferred deck of playing cards includes thirteen ranks of each of four suits: clubs (♣), diamonds (♦), hearts (♥) and spades (♠). Each suit includes an ace, king, queen, and jack, each depicted with a symbol of its suit; and ranks two through ten, with each card depicting that many symbols (pips) of its suit. The game may be played with or without Jokers, which, if included, may be wild cards. In a typical deck, cards of the clubs and spades suits are black, while cards of the diamonds and hearts suits are red.

A game according to principles of the invention is played with a unique indicator device. The indicator device includes a physical indicator (e.g., an acrylic device referred to herein as a button) for specifying which of two cards will be the primary card. The button has two opposed surfaces (e.g., a top and a bottom surface). Each surface is marked to indicate one of the two card positions. By way of example and not limitation, the top may be marked position 1 and the bottom may be marked position 2. More fanciful terms, such as "thunder" and "lightning", or dramatic terms such as "Faro's" and "Revenge", may be utilized in lieu of the generic terms. The sides may also be color coded to indicate the card positions. For example, the top may be blue, while the bottom may be green. As another alternative, various indicia may be displayed on the surfaces to indicate the card positions. Examples of such indicia are a "heads" and "tails" indicia, or a number I and II. The possible unique markings are endless.

A game table according to principles of the invention includes a tray or rack (i.e. the "rack"). The rack includes a plurality of shallow compartments. Each compartment is a receptacle with an open top and is configured to receive a button, with one or the other side facing up. Each compartment corresponds to a player position along the table. Each player takes a turn placing the indicator with the side corresponding to a position selected by the player (the "selected position") facing upwardly. The button with the selected position facing upwardly is then placed by the dealer in the player's designated compartment of the button rack, for the round of play. The side facing up can be seen by the dealer, each other player onlookers and security. The side facing up is the "selected position" for a hand (i.e., round) of play.

During a round of play, only one button is contained in one compartment of the rack. That compartment corresponds to a player position, i.e., the position (e.g., seat position) of the player whose turn it was to select a card position by placing the button in the compartment with a desired side of the button facing upwardly.

The rack is preferably attached to the table or securely placed on the table. In this manner, the selected position, as indicated by the upwardly facing side of the button contained in the compartment cannot be changed by bumping or otherwise jostling the rack.

A rack may further include a removable transparent cover for each compartment. The cover may snap, screw or pivot onto the top of the compartment. When the cover is closed on top of the compartment, a contained button is locked in the compartment with the selected position facing up. The cover should not be opened and the selected position should not be changed until the end of the round of play. As the cover is transparent, the selected position remains visible throughout the hand of play, while preventing tampering. The cover also prevents flipping of the button in the shallow compartment, such as by jostling the rack or sleight of hand.

An exemplary game table according to principles of the invention includes various indicia, including marked spaces. Among the marked spaces are a pair of spaces for two dealt cards. During a round of play, one dealt card will occupy each space. Each space is referred to herein as a position. Each position corresponds to one side of the button. For example, one side of the button corresponds to the left position, while the opposite side of the button corresponds to the right position.

The selected position, as indicated by the upwardly facing side of the button in the rack, corresponds to the dealt card position that is primarily in play. This positioning is referred to herein as the winning or selected position. Players try to predict, and wager on, among other things, the rank, suit, color and/or any combination of any of the foregoing for the card in the selected position. Players may also try to predict, and wager on, whether the two dealt cards are the same rank, suit and/or color.

The game is not limited to any specific types of wagers. Types of wagers may vary considerably within the scope of the invention. Any card attribute (rank, suit, color, odd/even), combinations of attributes for a card, attributes for both dealt cards, combinations of attributes for both dealt cards, and attributes and combinations of attributes for cards dealt in sequence may be types of wagers. Each type of wager includes indicia displayed on the game table layout. Wagers may be made by placement of chips or cheques on indicia on a game table. Players may make any type of wager by placing their chips on the corresponding indicia. As each player is provided uniquely colored chips, multiple players may place the same types of wagers without confusing (unintended commingling of) chips.

Players are not limited to a single wager per round of play. Rather, players may make one or more wagers per round of play.

In one preferred implementation, there are at least five types of wagers a player can make on each round of play of the game. A first type of wager is on a specific rank. Each player may wager on the rank (Ace through King) of the card in the selected position. Each player may wager on more than one rank to increase the chance of winning. In one exemplary implementation a winning rank wager may pay according to a schedule, which may be consistent for all cards, or vary. Illustratively, a winning rank wager may pay 12 to 1 on a black card and 11 to 1 on a red card.

A second type of wager is rank and suit combination. Each player may wager on one or more specific rank and suit combination. By way of example and not limitation, a player may wager on an Ace of spades and on a Jack of hearts. Illustratively, a winning rank and suit combination wager may pay 50 to 1.

A third type of wager is a suit. Each player may wager on one or more suits. By way of example and not limitation, a player may wager on a diamond and on a heart. Illustratively, a winning suit may pay 2 to 1. Alternatively, a variable payout schedule may be implemented for winning suit wagers. By way of example and not limitation, a winning suit may pay 2 to 1 on cards of the selected suit having a rank of 2 through 9, and pay another amount, such as 4 to 1, on cards of the selected suit having a rank of 10 through Ace.

A fourth type of wager is pairs. Each player may wager that the two dealt cards are a pair (i.e., the same rank). A winning pairs wager may pay 15 to 1.

A fifth type of wager is that the rank is either odd or even. Odd ranks include 3, 5, 7, 9, Jack, King. Even ranks include 2, 4, 6, 8, 10 and Queen. A winning odd or even wager may pay 1 to 1.

In an alternative implementation, one or more ranks may be set aside for special wagers. For example, a Jack (J) may reserved for special wagers. One such special wager (a compound wager) is "Wild Jacks," which wins when a Jack has been dealt in the selected position. A Wild Jacks wager is conceptually illustrated in FIG. 10. Other indicia may be used to represent a compound wager such as Wild Jacks. The amount won may depend upon both cards dealt. By way of example, when both dealt cards are Jacks, the payout may be 40 to 1; when the card in the selected position is a Jack and the other dealt card is a Joker, the payout may be 30 to 1; when the card in the selected position is a Jack and the other is an Ace, King or Queen, the payout may be 12 to 1; when the card in the selected position is a Jack and the other is an 8, 9 or 10, the payout may be 8 to 1; when the card in the selected position is a Jack and the other is a 2, 3, 4, 5, 6 or 7, the payout may be 6 to 1.

"Wild Jacks" is a non-limiting example of a compound wager, i.e., a single wager that provides multiple opportunities to win, with various combinations of attributes and various payouts. Compound wagers may be established for cards of other suits, within the scope of the invention.

Another example of a compound wager is "Jokers Plus 12," which wins when a Joker has been dealt in either card position, and a card of any rank (other than a rank required for another compound wager) is dealt in the other card position. A Jokers Plus 12 wager is conceptually illustrated in FIG. 11. Other indicia may be used to represent a compound wager such as Jokers Plus 12. The amount won may depend upon both cards dealt. By way of example, when one dealt card is a Joker and the other dealt card is an Ace, King or Queen, the payout may be 20 to 1; when one dealt card is a Joker and the other is a 7, 8, 9 or 10, the payout may be 12 to 1; when one dealt card is a Joker and the other is a 2, 3, 4, 5 or 6, the payout may be 9 to 1.

"Jokers Plus 12" is a non-limiting example of another compound wager, i.e., a single wager that provides multiple opportunities to win, with various combinations of attributes and various payouts. Compound wagers may be established for cards of other suits, within the scope of the invention.

Figure 12:
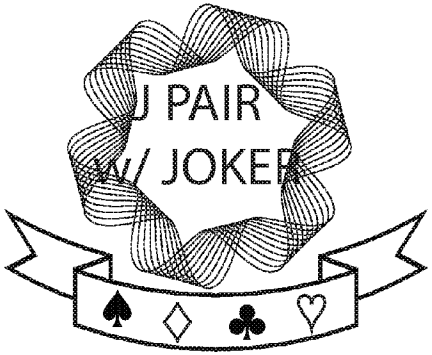
FIG. 12 is a schematic view of additional exemplary indicia displayed on a game table layout to guide wagering for a game according to principles of the invention.

Another type of wager is a J Pair with a Joker, as in FIG. 12. Such a wager may win when a pair of Jacks or a Jack and a Joker are dealt. The payout may be any predetermined amounts, such as 11 to 1 for a pair of Jacks and 3 to 1 for a Joker and a Jack.

Figure 13:
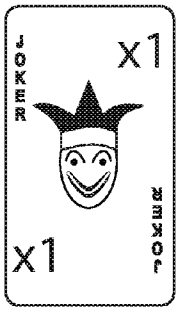
FIG. 13 is a schematic view of additional exemplary indicia displayed on a game table layout to guide wagering for a game according to principles of the invention.

Another type of wager is Any Single Joker, as in FIG. 13. This wager may win if a Joker is dealt in either position. Alternatively, this wager may win only when a Joker is dealt in the selected position. The payout may be any predetermined amounts, such as 25 to 1.

Figure 14:
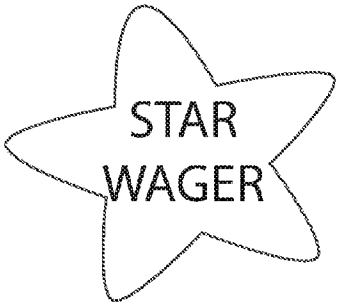
FIG. 14 is a schematic view of additional exemplary indicia displayed on a game table layout to guide wagering for a game according to principles of the invention.

Another example of a compound wager is a "Star Wager" as in FIG. 14. A Star Wager may win when the card in the selected position is an Ace and the other card is a King, Queen or Jack. The payout may be any predetermined amounts, such as 50 to 1 if the dealt cards are of the same suit, and 25 to 1 if they have different suits.

Figure 15:
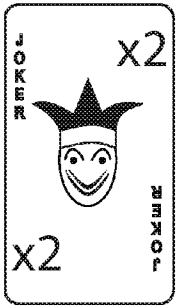
FIG. 15 is a schematic view of additional exemplary indicia displayed on a game table layout to guide wagering for a game according to principles of the invention.

Another type of wager is Double Jokers, as in FIG. 15. Such a wager wins when a pair of Jokers are dealt. The payout may be any predetermined amounts, such as 1200 to 1, with a limit on the amount wagered (e.g., a $1 limit) or a substantially lesser payout (e.g., 10 to 1) with no limit.

Other wagers may be devised that require a sequence of dealt cards. For example, a wager may win if certain cards are dealt in the selected position, or either position, or both positions in a sequence of hands.

The potential types of wagers are legion, only limited by creativity and available space on the table layout. Each wager requires indicia on the layout for players to place their chips.

In one embodiment, a layout may be modifiable. For example, overlays may be applied to a layout to change the types of wagers. An overlay may adhere magnetically, frictionally or with hook and loop fasteners to a layout. The top surface of the overlay may present one or more alternative wagers for players to choose. By way of example and not limitation, at a certain time (e.g., midnight) the dealer may apply an overlay that offers players more favorable payouts, better odds of winning, or creative unique types of wagers.

A game according to principles of the invention is played by establishing the number and order of players, allowing the player going first to select a card position by placing the button in the appropriate compartment of the button rack, receiving wagers, dealing the cards to the two positions, determining winning wagers and losing wagers, and paying out on winning wagers, and taking losing wagered chips or checks. This process repeats with each successive player having a turn to select a position by placing the button in the appropriate compartment of the button rack.

The dealer should be proficient in controlling game play, shuffling the deck, placement of the cards to be played, handling wagers. To shuffle the cards, the dealer follows a sequence defined by the casino, which may, for example, entail "washing" the cards by spreading them out on the table and pushing them around randomly, then collecting the cards and squaring them into a deck for a shuffling sequence. Automatic shufflers may optionally be used. The invention is not limited to a particular shuffling methodology.

Shuffled cards may be dealt from a hand held deck or a shoe. One or more cards may be "burned" from the top of the deck, i.e., placed in a discard pile, to ensure that the top card was not made visible to players during a previous betting round or preparation.

Dealers control the action during a round of play. This may include prodding players to act, verbally announcing actions of players to the rest of the table, and correcting players who act out of turn. Players do not touch cards.

Dealers also must manage wagers. The dealer may verify the amount and types of wagers, collect losing wagers for the house, and payout on winning wagers according to a payout schedule. To minimize confusion for both players and dealers, the game is preferably played with color coordinated chips, with each player having chips of one color, all of which are different from the color of the chips used by each other player. Players may make one or more wagers for each round of play.

Figure 2:
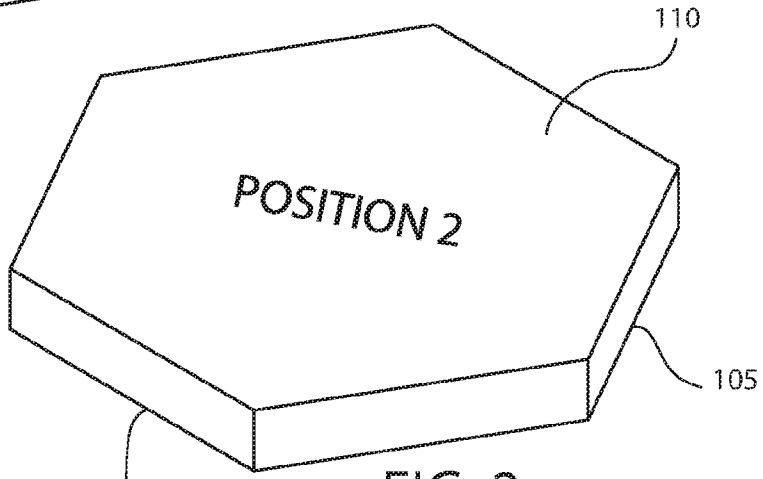
FIG. 2 is a bottom-side perspective view of an exemplary button for a game according to principles of the invention.

Referring now to FIGS. 1 and 2 both sides of an exemplary button 100 for a game according to principles of the invention are conceptually illustrated. The button may be comprised of any suitable material for a playing piece, including metal, composites, wood and plastic. The hexagonal prism shape is provided as an example. Other shapes may be used. While the size of the button may vary, it should large enough to be readily visible to the dealer, players, nearby onlookers and security, without being cumbersome to handle. At least an inch diameter, but nor more than a 3 inch diameter is preferred. One side is marked to correspond to one of the two card position 105, and the opposite side is marked to correspond to the other of the two card positions 110. While generic descriptions ("POSITION 1" and "POSITION 2") are shown in the Figures, more fanciful and dramatic terminology, and other artistic elements may be displayed on the game table at the card positions to differentiate the card positions and displayed on the sides of the button. By way of example and not limitation, one card position may be marked on the table layout as "Faro's" and the other card position may be marked on the table layout as "Revenge." Concomitantly, one side of the button may be marked as "Faro's" and the other side of the button may be marked as "Revenge."

Figure 3:
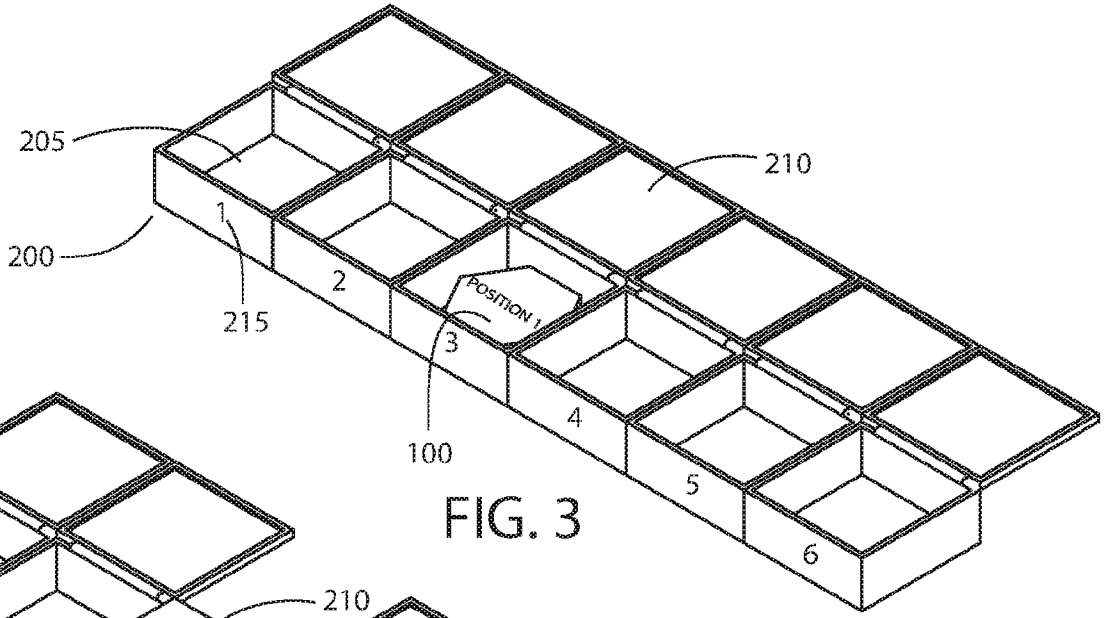
FIG. 3 is a perspective view of an exemplary button in a compartment of a button rack corresponding to a third player for a game according to principles of the invention.
Figure 4:
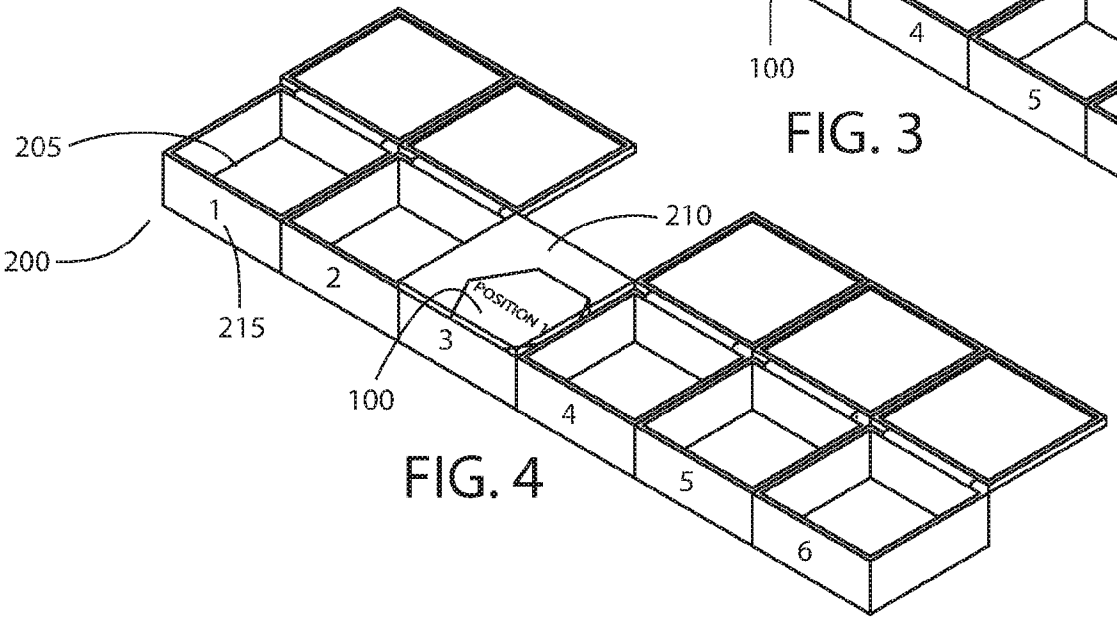
FIG. 4 is a perspective view of an exemplary button in a compartment of a button rack corresponding to a third player with a closed transparent lid for a game according to principles of the invention.

FIGS. 3 and 4 conceptually illustrate one nonlimiting example of a button rack 200 for a game according to principles of the invention. The rack 200 is comprised of a plurality of compartments 205, each sized to receive the button 100 with one side facing upwardly. Each compartment is marked 215 with a player seat position. In the illustrations of FIGS. 3 and 4, a button 100 is contained in the third compartment, with the position 1 side facing upwardly. In FIG. 3, the cover 210 for compartment 3 is open, while in FIG. 4 the cover is closed. Each covers may slide, pivot or be placed over its respective opening. The cover 210 is transparent. While a separate transparent hinged cover 210 is shown for each compartment of the rack 200, in an alternative embodiment, one cover may be used. That cover may be placed on the active compartment containing the button during the round of play. In yet another embodiment, other means of closure of covers, such as sliding closures, may be used for the one or more covers.

Referring now to FIGS. 5 through 15, a game table layout according to principles of the invention is marked with indicia for card placement, wagering, and informing all participants of payouts. The table layout may be ornate, including various other artwork and information as determined by a casino.

Figure 5:
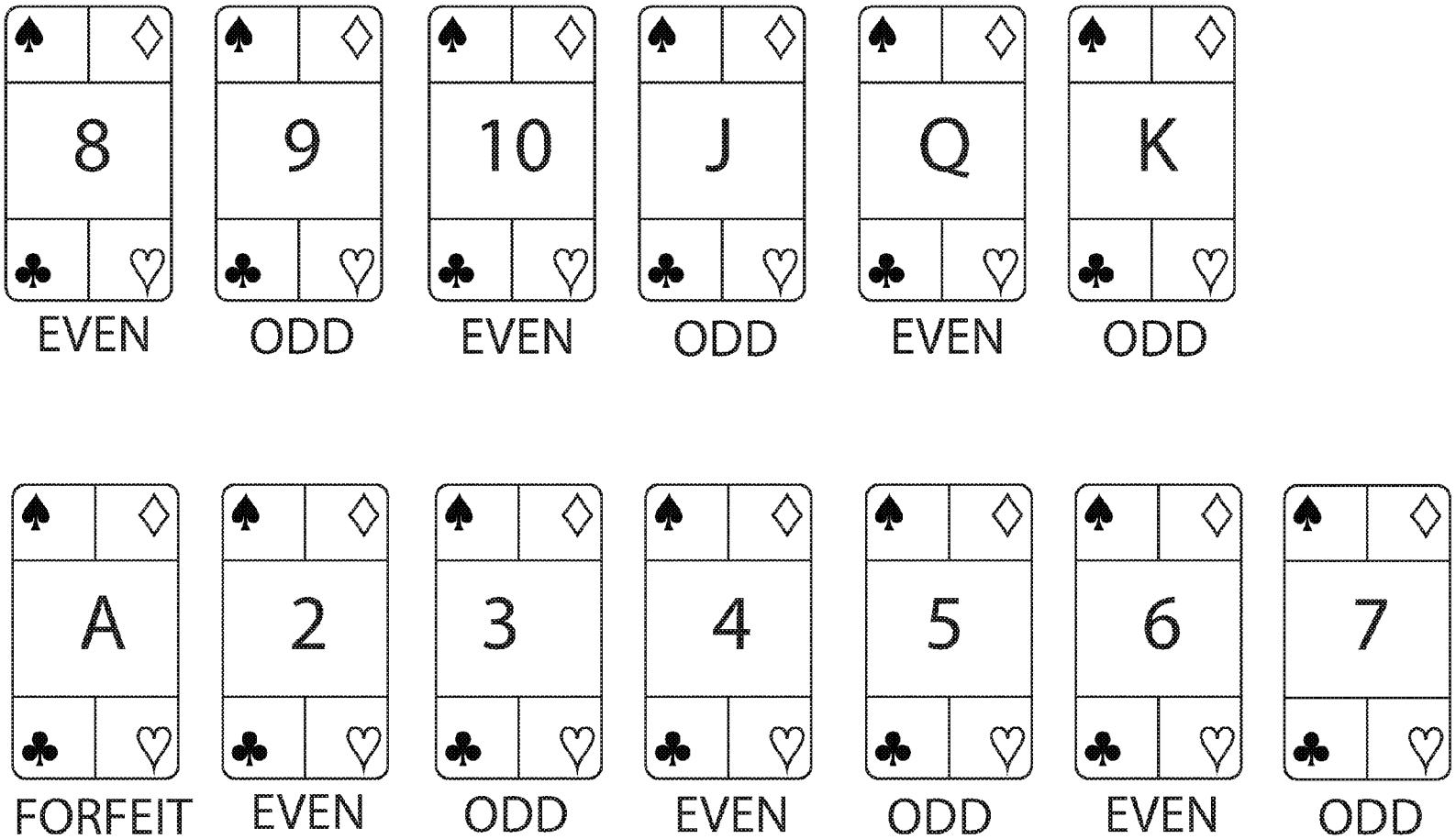
FIG. 5 is a schematic view of exemplary indicia displayed on a game table layout to guide wagering for a game according to principles of the invention.

With particular reference to FIG. 5, the layout preferably displays indicia for receiving wagering on rank, or rank and suit, such as the indicia shown in FIG. 5. A player may place chips on a rank or on a suit for a particular rank to make such a bet. The schematic of FIG. 5 also informs the player of which ranks are considered odd and even.

Figure 6:
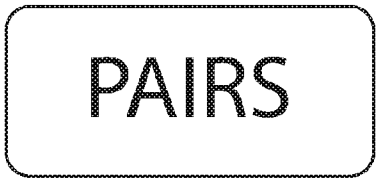
FIG. 6 is a schematic view of an exemplary indicia displayed on a game table layout to guide wagering for a game according to principles of the invention.

With particular reference to FIG. 6 the layout preferably displays indicia for receiving wagering on pairs (i.e., that the two dealt cards will have the same rank), such as the indicia shown in FIG. 6. A player may place chips on a pairs indicia to make such a bet. The schematic of FIG. 6 also informs the player of the payout for a winning wager.

Figure 7:
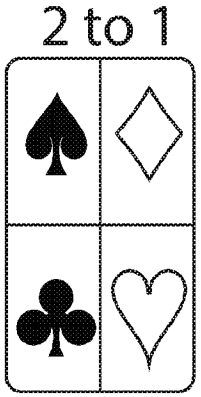
FIG. 7 is a schematic view of exemplary indicia displayed on a game table layout to guide wagering for a game according to principles of the invention.

With particular reference to FIG. 7 the layout preferably displays indicia for receiving wagering on suit alone, such as the indicia shown in FIG. 7. A player may place chips on a suit indicia to make such a bet. The schematic of FIG. 7 also informs the player of the payout for a winning wager.

Figure 8:
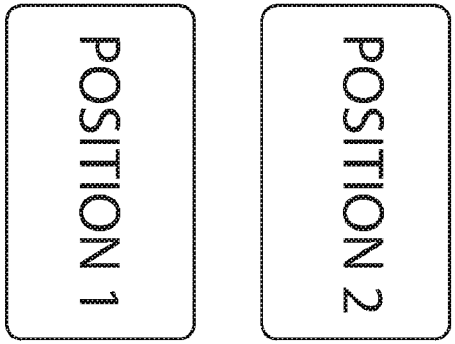
FIG. 8 is a schematic view of exemplary indicia displayed on a game table layout for placement of two dealt cards during each round of play for a game according to principles of the invention.

With particular reference to FIG. 8 the layout preferably displays indicia for placement of the two dealt cards. While the positions are generically identified in the schematic, it is understood that fanciful and dramatic designations may be used.

Figure 9:
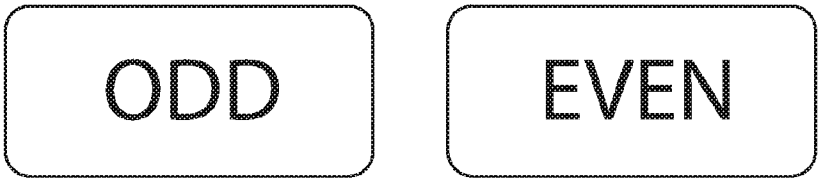
FIG. 9 is a schematic view of exemplary indicia displayed on a game table layout to guide wagering for a game according to principles of the invention.

With particular reference to FIG. 9 the layout preferably displays indicia for receiving wagering on odd or even, such as the indicia shown in FIG. 9. A player may place chips on an odd or even indicium to make such a bet. The schematic of FIG. 9 also informs the player of the payout for a winning wager.

Figure 10:
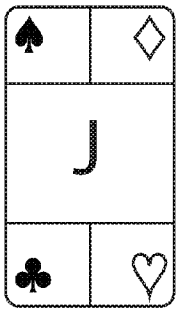
FIG. 10 is a schematic view of additional exemplary indicia displayed on a game table layout to guide wagering for a game according to principles of the invention.

In an alternative implementation, with particular reference to FIG. 10, the layout may display indicia for a compound wager, namely "Wild Jacks," which wins when a Jack has been dealt in the selected position. The amount won may depend upon both cards dealt. Specifics may be printed on the table layout. By way of example, the layout may explain that when both dealt cards are Jacks, the payout may be 40 to 1; when the card in the selected position is a Jack and the other dealt card is a Joker, the payout may be 30 to 1; when the card in the selected position is a Jack and the other is an Ace, King or Queen, the payout may be 12 to 1; when the card in the selected position is a Jack and the other is an 8, 9 or 10, the payout may be 8 to 1; when the card in the selected position is a Jack and the other is a 2, 3, 4, 5, 6 or 7, the payout may be 6 to 1.

Figure 11:
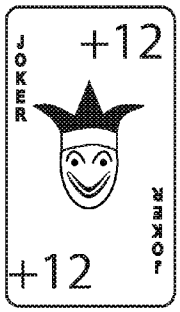
FIG. 11 is a schematic view of additional exemplary indicia displayed on a game table layout to guide wagering for a game according to principles of the invention.

With particular reference to FIG. 11, the layout may display indicia for another compound wager, namely "Jokers Plus 12," which wins when a Joker has been dealt in either card position, and a card of any rank (other than a rank required for another compound wager) is dealt in the other card position. The layout may display an explanation that the amount won may depend upon both cards dealt. By way of example, when one dealt card is a Joker and the other dealt card is an Ace, King or Queen, the payout may be 20 to 1; when one dealt card is a Joker and the other is a 7, 8, 9 or 10, the payout may be 12 to 1; when one dealt card is a Joker and the other is a 2, 3, 4, 5 or 6, the payout may be 9 to 1.

With particular reference to FIG. 12, the layout may display indicia for another wager, namely, J Pair with a Joker. The layout may explain that such a wager may win when a pair of Jacks or a Jack and a Joker are dealt. The payout may be any predetermined amounts, such as 11 to 1 for a pair of Jacks and 3 to 1 for a Joker and a Jack.

With particular reference to FIG. 13, the layout may display indicia for another type of wager, namely Any Single Joker. The layout may explain that the wager may win if a Joker is dealt in either position. Alternatively, this wager may win only when a Joker is dealt in the selected position. The payout may be any predetermined amounts, such as 25 to 1.

With particular reference to FIG. 14, the layout may display indicia for another compound wager, namely a "Star Wager." The layout may explain that a Star Wager may win when the card in the selected position is an Ace and the other card is a King, Queen or Jack. The payout may be any predetermined amounts, such as 50 to 1 if the dealt cards are of the same suit, and 25 to 1 if they have different suits.

With particular reference to FIG. 15, the layout may display indicia for another type of wager, namely Double Jokers. Such a wager wins when a pair of Jokers are dealt. The payout may be any predetermined amounts, such as 1200 to 1, with a limit on the amount wagered (e.g., a $1 limit) or a substantially lesser payout (e.g., 10 to 1) with no limit.

The aforementioned types of wagers, payouts and explanations that may be displayed on the game table layout, are provided as nonlimiting examples. Other types of wagers, payouts and explanations may be displayed without departing from the scope of the invention. The invention is not limited to any particular wager, payout or explanation.

Figure 16:
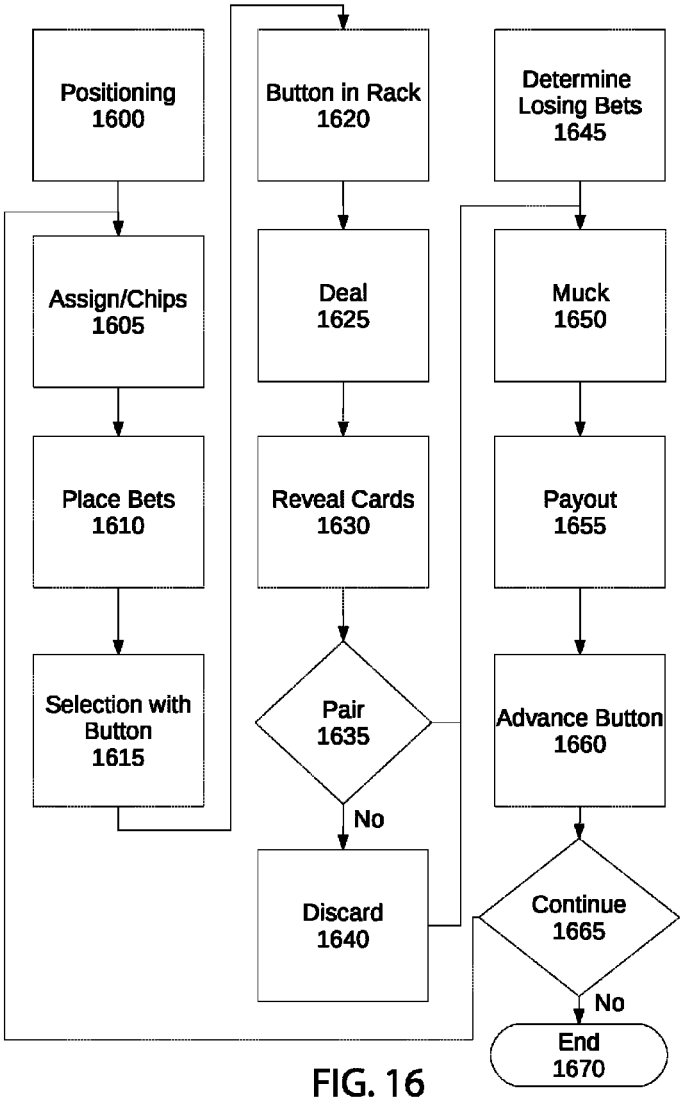
FIG. 16 is a high level flowchart of steps of an exemplary round of play of a game according to to principles of the invention.

A nonlimiting example of an exemplary round of game play according to principles of the invention will now be described with reference to the flowchart of FIG. 16. On an opened game with no play, the button may positioned on a table below cards which have been spread on the table presented for play, as in step 1600. As used herein, below means closer to the players. One or more players may come to the table to buy in. The dealer then collects the cards which were dead spread, according to the casino's house policy, and places the cards which were spread in a discard rack, issues the button to the first player, exchanges cash money from each player (who just came to the table), for non-value chips or cheques (collectively herein "chips"), which may be color coded per player, as in step 1605. The dealer then gives the chips to the player and drops the cash in the slot designated for cash drop. Each player is in a position along the table, which corresponds to a position on the button rack. For example, in a round with six players, one player is the first player (i.e., in the first position or seat) and associated with the first position of the button rack; the next player is the second player (i.e., in the second position or seat) and associated with the second position of the button rack, and so on. The dealer may open the lid of the compartment of the button rack that corresponds to the player having the turn. The dealer then instructs players to place their bets, as in step 1610. The players then place their wagers. The dealer then declares, after a brief period, that no more bets may be placed and makes a gesture to memorialize the declaration. The gesture may entail waving one or more arms or hands over the layout, signifying no more action is allowed on the layout. The dealer then prompts the player who has the turn and was given the button/device to select a card position using the button. To select a card position the player turns the button with a side facing upward, as in step 1615. The side facing upward identifies the position of the card to be dealt that will primarily be in play. By way of example and not limitation, if one card space is nominated "Faro's" and the other card space is nominated "Revenge", the button may have one side that displays "Faro's" and the opposite side that displays "Revenge". The player places the button with the selected side facing upwardly. The dealer then retrieves the button from the player and places it in the button rack, with the selected side up, in the slot corresponding to the selecting player's position, as in step 1620. The button rack may be marked to identify each compartment by player position. Thus, any person viewing the button rack can determine the selecting player and the choice that the selecting player has made for the round of play. The dealer may then take the cards out of the discard rack, complete the shuffle (according to house policy) and place the cards in a dealing shoe. The dealer then deals, i.e., removes, a specific number of cards from the shoe according to house procedures for dealing, as in step 1625. The removed cards may include more than the two cards that will be placed on the first and second card positions. Excess (burn) cards may be placed in the discard rack. Two cards that are not burned are placed on the first and second card positions on the table layout. It does not matter which square is dealt first. The dealer then turns over the two cards in their respective positions on the game table layout, as in step 1630. The dealer announces the selected position according to the choice of the selecting player, as indicated by the button on display in the button rack. If the two cards deposited in the positions on the layout do not match (i.e., do not have the same rank), as determined in step 1635, then, unless compound wagers were placed, the dealer may immediately take the card in the non-selected position, turn it over and deposit it within the excess cards in the discard rack, as in step 1640. Then there are only cards in play on the game table layout. The dealer may then place a dolly (e.g., a dolly marker or roulette-type marker) on the active card or cards on the game table layout. If the cards are a pair or compound wagers have been placed, then both cards may be on the table. If the cards were not a pair and no compound wagers were placed, then only the card in the selected position may be on the table. The dealer then determines losers and mucks (i.e., removes) all chips for all losing wagers off the game table layout, as in steps 1645 and 1650. The dealer then pays out all winners according to the pay table, which is preferably conspicuously printed on the game table layout, as in step 1655. The dealer then takes the dolly off game table layout. The dealer then removes the card or cards remaining in the positions and places the removed cards with the excess cards already in the discard rack according to house procedures. The dealer may then remove excess cards left in the shoe and place them in the discard rack as well. The dealer then instructs the players again to place their bets. The dealer then hands the button, which was in the button tray rack, to the next player, e.g., the player to the right of the previous selecting player, as in step 1660. If another hand will be played by one or more players, the process may resume, as in step 1665. Otherwise, play may come to an end, as in step 1670.

Figure 17:
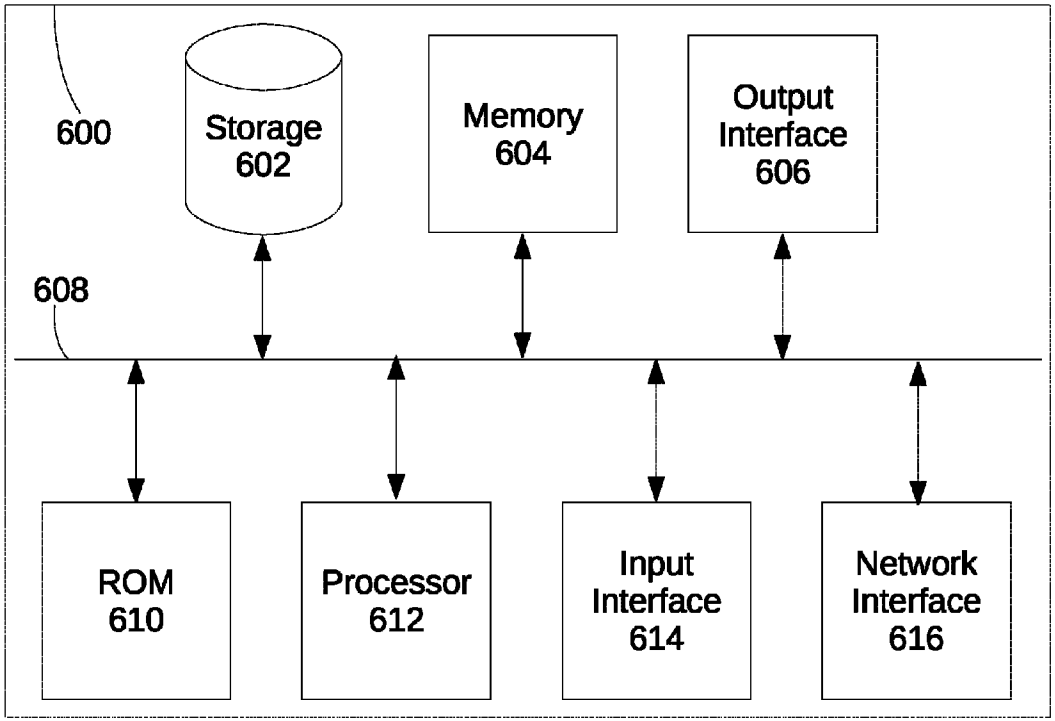
FIG. 17 is a high-level block diagram conceptually illustrating components of a computer implemented system for a game according to principles of the invention.

FIG. 17 conceptually illustrates an electronic system with which a computer game version of the invention is implemented. Electronic system 600 can be a server, computer, phone, PDA, laptop, tablet computer, television, kiosk, game console or casino machine with one or more processors embedded therein or coupled thereto, or any other sort of electronic device suitable for game play. Such an electronic system includes may include various types of computer readable media and interfaces for various other types of computer readable media. Electronic system 600 includes a bus 608, processing unit(s) 612, a system memory 604, a read-only memory (ROM) 610, a permanent storage device 602, an input device interface 614, an output device interface 606, and a network interface 616. Bus 608 collectively represents all system, peripheral, and chipset buses that communicatively connect the numerous internal devices of electronic system 600. For instance, bus 608 communicatively connects processing unit(s) 612 with ROM 610, system memory 604, and permanent storage device 602. From these various memory units 604, 610, processing unit(s) 612 retrieves instructions to execute and data to process in order to execute the processes of the subject disclosure. The processing unit(s) can be a single processor or a multi-core processor in different implementations. ROM 610 stores static data and instructions that are needed by processing unit(s) 612 and other modules of the electronic system. Permanent storage device 602, on the other hand, is a read-and-write memory device. This device is a non-volatile memory unit that stores instructions and data even when electronic system 600 is off. Some implementations of the subject disclosure use a mass-storage device (such as a solid-state-drive or magnetic or optical disk and its corresponding disk drive) as permanent storage device 602. Other implementations use a removable storage device (such as a flash drive, and its corresponding disk drive) as permanent storage device 602. Like permanent storage device 602, system memory 604 is a read-and-write memory device. However, unlike storage device 602, system memory 604 is a volatile read-and-write memory, such a random access memory. System memory 604 stores some of the instructions and data that the processor needs at runtime.

In some implementations, the processes of the subject disclosure are stored in system memory 604, permanent storage device 602, and/or ROM 610. For example, the various memory units include instructions for facilitating a card game as described above, displaying card positions, dealt cards, a binary selector to pick one of the card positions, and various controls, screens or icons for making various types of wagers.

Bus 608 also connects to input and output device interfaces 614 and 606. Input device interface 614 enables the user to communicate information and select commands to the electronic system. Input devices used with input device interface 614 include, for example, alphanumeric keyboards and pointing devices (also called "cursor control devices"). Output device interfaces 606 enables, for example, the display of images generated by the electronic system 600. Output devices used with output device interface 606 include, for example, printers and display devices, such as cathode ray tubes (CRT), or liquid crystal displays (LCD), or LED displays. Some implementations include devices such as a touchscreen that functions as both input and output devices.

Finally, as shown in FIG. 17, bus 608 also couples electronic system 600 to a network (not shown) through a network interface 616. In this manner, the computer can be a part of a network of computers (such as a local area network ("LAN"), a wide area network ("WAN"), or an Intranet, or a network of networks, such as the Internet. Any or all components of electronic system 600 can be used in conjunction with the subject disclosure.

The steps of game play described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, read-only and recordable Blu-Ray® discs, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "server", "processor", and "memory" all refer to electronic or other technological devices. These terms exclude people or groups of people. For the purposes of the specification, the terms display or displaying means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

To provide for interaction with a user, implementations of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

Implementations of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some implementations, a server transmits data (e.g., an HTML page) to a client device (e.g., for purposes of displaying data to and receiving user input from a user interacting with the client device). Data generated at the client device (e.g., a result of the user interaction) can be received from the client device at the server.

In such a computerized implementation, the tangible items described above are implemented in virtual form. Elements of game play may be implemented as audio visual elements displayed on a screen, output from a speaker, user-selectable controls (e.g., buttons, joysticks, touchscreen elements, other pointing devices), and payment inputs.

A game according to principles of the invention is not limited to dealing two cards. Additional cards may be dealt during some or all hands, with the additional cards in excess of 2 being provided for wagers that require more than two cards. For example, if three cards are dealt, including two cards in the dealt positions described above, and an extra card, then some wagers may be based upon characteristics (rank, suit, color, odd/even) of all 3 cards or a combination of any two of the three cards, such as a combination of the first and third or the second and third cards, or the third card.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A method of playing a card game comprising steps of:

providing a deck of cards, a playing table, a two-sided selector, a selector rack, and a plurality of wagering tokens, said playing table including a first indicia for a first card position, a second indicia for a second card, a third indicia for a first wager, and a fourth indicia for a second wager;

said two-sided selector including a first side marked to indicate the first card position, and a second side marked to indicate the second card position, the second side being opposite the first side;

said selector rack including at least one compartment for receiving the two-sided selector with one of the first and second side facing upward;

selecting one of the first card position and second card position by placing the two-sided selector with the side corresponding to a selected one of the first card position and second card position facing upwardly;

placing the two-sided selector with the side corresponding to a selected one of the first card position and second card position facing upwardly in the at least one compartment of the selector rack;

placing at least one wagering token on at least one of the third indicia for the first wager and the fourth indicia for the second wager;

dealing two cards from the deck of cards, said dealing comprising placing one card from the deck on the first indicia for the first card position and placing another card from the deck on the second indicia for a second card; and determining if the at least one wager wins in relation to the dealt card in the one of the first card position and second card position corresponding to the side of the two-sided selector facing upwardly in the compartment of the selector rack, said dealt card being the selected card.

2. The method of playing a card game according to claim 1, further comprising a step of determining if the one card from the deck on the first indicia for the first card position and the other card from the deck on the second indicia for the second card have the same rank.

3. The method of playing a card game according to claim 2, further comprising a step of, if the one card from the deck on the first indicia for the first card position and the other card from the deck on the second indicia for the second card do not have the same rank, then removing the dealt card that is not the selected card.

4. The method of playing a card game according to claim 1, said playing table further including a fifth indicia for a third wager, and a sixth indicia for a fourth wager, and a seventh indicia for a fifth wager.

5. The method of playing a card game according to claim 1, said first wager comprising a wager from the group consisting of a rank, a rank and a suit, a suit and a color.

6. The method of playing a card game according to claim 1, said second wager comprising a wager from the group consisting of an odd or even association and a pair.

7. The method of playing a card game according to claim 1, said dealing comprising placing one card from the deck face down on the first indicia for the first card position and placing another card from the deck face down on the second indicia for a second card.

8. The method of playing a card game according to claim 1, said dealing comprising placing one card from the deck face down on the first indicia for the first card position and placing another card from the deck face down on the second indicia for a second card, and subsequently turning each dealt card face up.

9. The method of playing a card game according to claim 1, said selector rack further including at least one cover for the at least one compartment for receiving the two-sided selector with one of the first and second side facing upward, said at least one cover being movable from an open position allowing access to the at least one compartment to a closed position preventing access to the at least one compartment.

10. The method of playing a card game according to claim 9, said at least one cover being transparent.

11. The method of playing a card game according to claim 9, said at least one cover being slidable from the open position to the closed position.

12. The method of playing a card game according to claim 9, said at least one cover being attached by a hinge and pivotable from the open position to the closed position.

13. The method of playing a card game according to claim 9, said at least one cover being removable.

14. The method of playing a card game according to claim 9, further comprising a step of moving the at least one cover to the closed position after the two-sided selector has been placed in the at least one compartment of the selector rack.

15. The method of playing a card game according to claim 1, said the at least one compartment of the selector rack including a separate compartment assigned for each player position.

16. The method of playing a card game according to claim 15, said step of selecting one of the first card position and second card position by placing the two-sided selector with the side corresponding to a selected one of the first card position and second card position facing upwardly comprising having a first player in a first player position perform the selection; and said step of placing the two-sided selector with the side corresponding to a selected one of the first card position and second card position facing upwardly in the at least one compartment of the selector rack comprising placing the two-sided selector in the compartment assigned for a first player position.

17. The method of playing a card game according to claim 1, further comprising paying according to a determined payout schedule if the at least one wager wins in relation to the dealt card in the one of the first card position and second card position corresponding to the side of the two-sided selector facing upwardly in the compartment of the selector rack.

18. The method of playing a card game according to claim 1, said playing table further including a fifth indicia for a third wager, and a sixth indicia for a fourth wager, and a seventh indicia for a fifth wager, the first wager being a rank, the second wager being a rank and a suit, the third wager being a suit, the fourth wager being a pair, and the fifth wager being an odd/even designation.

19. A method of playing a card game comprising steps of:

providing a deck of cards, a playing table, a two-sided selector, a selector rack, and a plurality of wagering tokens, said playing table including a first indicia for a first card position, a second indicia for a second card, a third indicia for a first wager, and a fourth indicia for a second wager;

said two-sided selector including a first side marked to indicate the first card position, and a second side marked to indicate the second card position, the second side being opposite the first side;

said selector rack including at least one compartment for receiving the two-sided selector with one of the first and second side facing upward, said at least one compartment of the selector rack including a separate compartment assigned for each player position, said selector rack further including at least one transparent cover for the at least one compartment for receiving the two-sided selector with one of the first and second side facing upward, said at least one transparent cover being movable from an open position allowing access to the at least one compartment to a closed position preventing access to the at least one compartment;

selecting one of the first card position and second card position by placing the two-sided selector with the side corresponding to a selected one of the first card position and second card position facing upwardly;

placing the two-sided selector with the side corresponding to a selected one of the first card position and second card position facing upwardly in the at least one compartment of the selector rack;

moving the at least one cover to the closed position after the two-sided selector has been placed in the at least one compartment of the selector rack;

placing at least one wagering token on at least one of the third indicia for the first wager and the fourth indicia for the second wager;

dealing two cards from the deck of cards, said dealing comprising placing one card from the deck on the first indicia for the first card position and placing another card from the deck on the second indicia for a second card; and determining if the one card from the deck on the first indicia for the first card position and the other card from the deck on the second indicia for the second card have the same rank determining if the at least one wager wins in relation to the dealt card in the one of the first card position and second card position corresponding to the side of the two-sided selector facing upwardly in the compartment of the selector rack, said dealt card being the selected card.

20. The method of playing a card game according to claim 19, further comprising a step of, if the one card from the deck on the first indicia for the first card position and the other card from the deck on the second indicia for the second card do not have the same rank, then removing the dealt card that is not the selected card.

* * * * *